US010071297B2

(12) United States Patent
Alexander

(10) Patent No.: US 10,071,297 B2
(45) Date of Patent: Sep. 11, 2018

(54) TRAINING APPARATUS FOR BALL-PLAYING SPORTS

(71) Applicant: Alexvision LLC, Hayward, CA (US)

(72) Inventor: Scot Edward Alexander, Hayward, CA (US)

(73) Assignee: Alexvision LLC, Hayward, CA (US)

( * ) Notice: Subject to any disclaimer, the term of this patent is extended or adjusted under 35 U.S.C. 154(b) by 0 days.

(21) Appl. No.: 15/698,711

(22) Filed: Sep. 8, 2017

(65) Prior Publication Data

US 2018/0071607 A1 Mar. 15, 2018

Related U.S. Application Data

(60) Provisional application No. 62/394,015, filed on Sep. 13, 2016.

(51) Int. Cl.

| | |
|---|---|
| ***A63B 69/00*** | (2006.01) |
| ***A63B 69/38*** | (2006.01) |
| ***A63B 24/00*** | (2006.01) |

(52) U.S. Cl.

CPC ..... *A63B 69/0086* (2013.01); *A63B 24/0003* (2013.01); *A63B 69/00* (2013.01); *A63B 69/0002* (2013.01); *A63B 69/002* (2013.01); *A63B 69/0071* (2013.01); *A63B 69/0084* (2013.01); *A63B 69/0095* (2013.01); *A63B 69/38* (2013.01); *A63B 2209/00* (2013.01); *A63B 2220/51* (2013.01); *A63B 2225/09* (2013.01); *A63B 2243/007* (2013.01)

(58) Field of Classification Search

USPC ..... 473/215, 424, 438, 573; 273/DIG. 17–DIG. 19

See application file for complete search history.

(56) References Cited

U.S. PATENT DOCUMENTS

| | | | | | |
|---|---|---|---|---|---|
| 667,563 | A * | 2/1901 | Oakley | A63B 69/007 | 273/429 |
| 4,021,035 | A * | 5/1977 | O'Hara | A63B 69/0086 | 273/DIG. 19 |
| 4,247,117 | A * | 1/1981 | Reichert | A63B 69/0086 | 473/424 |
| 5,080,045 | A * | 1/1992 | Reese | A01K 27/005 | 119/770 |
| 5,586,760 | A * | 12/1996 | Hauter | A63B 69/0086 | 273/DIG. 19 |
| 5,591,089 | A * | 1/1997 | Huffines | A63B 69/3608 | 273/DIG. 19 |
| 5,611,540 | A * | 3/1997 | Williams | A63B 43/007 | 473/429 |
| 6,152,838 | A * | 11/2000 | Killion | A63B 43/007 | 273/331 |

(Continued)

*Primary Examiner* — Nini Legesse

(74) *Attorney, Agent, or Firm* — Rimon, P.C.; Marc S. Kaufman

(57) ABSTRACT

A training apparatus for ball-playing sports comprising a tether having a first end affixed to a connector module and a second end affixed to a ball securing device. The ball securing device is configured to secure a ball therein. A belt may be configured to have the connector module engaged therewith where the belt is to be worn around a waist of a user. The connector module operable to traverse a length of the belt in response to a throwing force applied to the ball.

7 Claims, 4 Drawing Sheets

(56) References Cited

U.S. PATENT DOCUMENTS

| | | | | |
|---|---|---|---|---|
| 2013/0210559 | A1* | 8/2013 | Ruvoli | A63B 69/0059 473/458 |
| 2014/0329622 | A1* | 11/2014 | Marshall | A63B 69/0086 473/424 |

* cited by examiner

TRAINING APPARATUS FOR BALL-PLAYING SPORTS

RELATED APPLICATION DATA

This application claims benefit from U.S. Provisional Application Ser. No. 62/394,015 filed on Sep. 13, 2016, the disclosure of which is incorporated herein by reference in its entirety.

BACKGROUND

The game of basketball is ubiquitous today, especially as part of a high school or college athletics department. Because top basketball athletes may receive college scholarships, it is advantageous to practice the sport as much as possible. Currently, several basketball techniques practiced during drills require multiple individuals working together to implement. For example, practicing chest passes, outlet passing, overhead pass, three dribble into a one hand pass, rebound into outlet pass, require a first player to toss the ball and a second player to catch it. Additional drills that require a second player include: dribble and jump shoot, "two-man" wall pass, behind-the-back pass, "swing pass, drive, and kick," post play, swinging the ball, opposite hand workout, shooting drills, and catch & shoot. The repetitive nature of the techniques is what helps the player hone his/her skills. This situation is similar for other sports.

SUMMARY

According to one aspect, an apparatus comprising a tether having a first end affixed to a connector module and a second end affixed to a sleeve, wherein the sleeve is configured to secure a ball therein; and a belt configured to have the connector module engaged therewith, the belt configured to be worn around a waist of a user, the connector module operable to traverse a length of the belt.

According to another aspect, an apparatus comprising a sleeve having a plurality of longitudinal strips fastened to form a pouch to hold a ball; a tether having a first end fastened to a carabiner clip and a second end fastened to the sleeve; and a belt configured to be worn around a waist of a user, the belt having the carabiner clip fastened thereto, the carabiner clip configured to traverse a length of the belt in response to a force applied to the ball.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION

Figure 1:
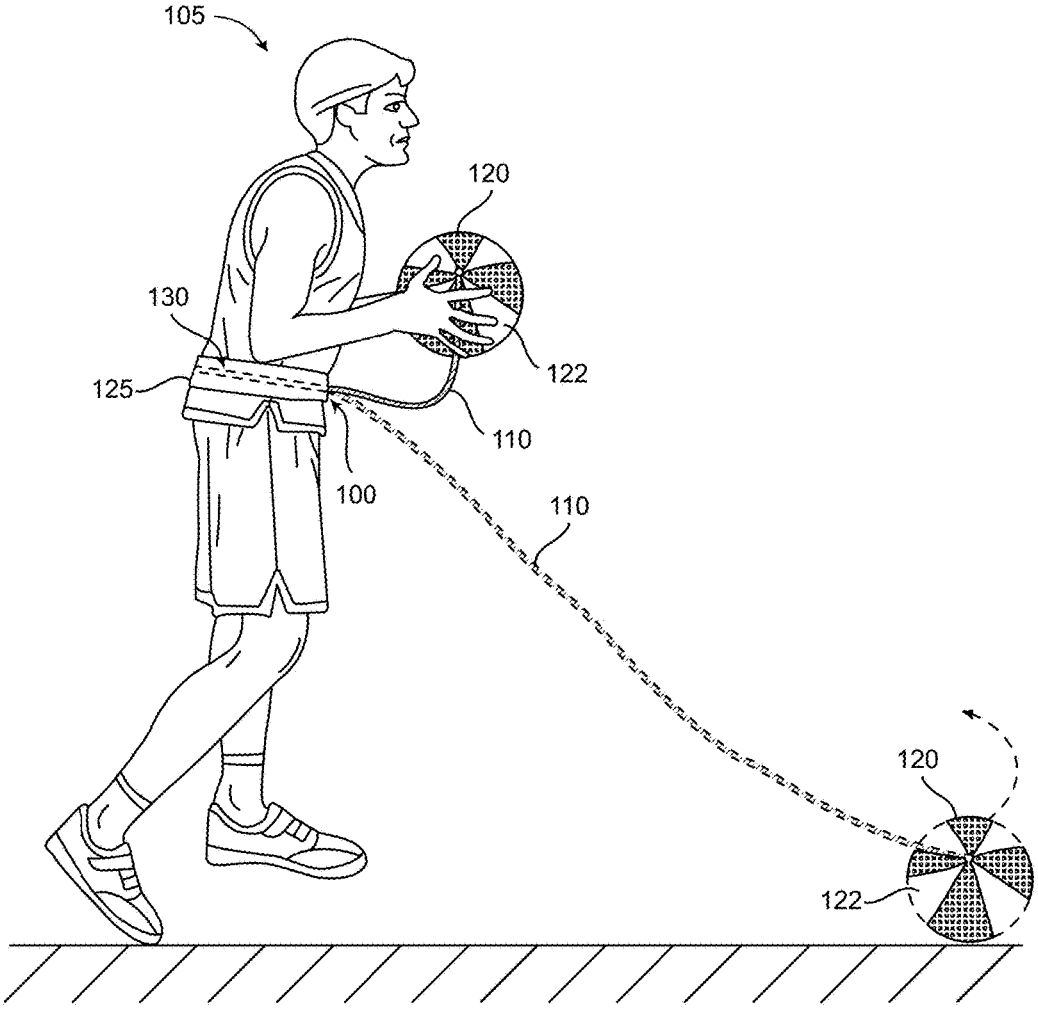
FIG. 1 is a schematic illustration of a basketball training apparatus being used by a player, according to one illustrated embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Various examples of embodiments of the invention will now be described. The following description provides specific details for a thorough understanding and enabling description of these examples. One skilled in the relevant art will understand, however, that embodiments of the invention may be practiced without many of these details. Likewise, one skilled in the relevant art will also understand that embodiments incorporate many other obvious features not described in detail herein. Additionally, some well-known structures or functions may not be shown or described in detail below, so as to avoid unnecessarily obscuring the relevant description.

The terminology used herein is to be interpreted in its broadest reasonable manner, even though it is being used in conjunction with a detailed description of certain specific examples of the invention. Indeed, certain terms may even be emphasized below; any terminology intended to be interpreted in any restricted manner will, however, be overtly and specifically defined as such in this Detailed Description section.

The figures along with the following discussion provide a brief, general description of a suitable environment in which embodiments of the invention can be implemented. Although not required, aspects of various embodiments described below are also contemplated in the general context of computer-executable instructions, such as routines executed by a general purpose data processing module, e.g., a networked server computer, cloud server, mobile device, tablet, or personal computer. Those skilled in the relevant art will appreciate that embodiments can be practiced with other communications, data processing, or computer system configurations, including: Internet appliances, hand-held devices (including smart phones, tablets, and personal digital assistants (PDAs)), wearable computers, all manner of corded, landline, fixed line, cordless, cellular or mobile phones, smart phones, multi-processor systems, microprocessor-based or programmable consumer electronics, set-top boxes, network PCs, mini-computers, mainframe computers, media players and the like. Indeed, the terms "computer," "server," and the like are generally used interchangeably herein, and refer to any of the above devices and systems, as well as any data processor.

While embodiments of the invention, such as certain functions, may be described as being performed on a single device, embodiments of the invention can also be practiced in distributed environments where functions or modules are shared among disparate processing devices, which are linked through a communications network, such as, for example, a Local Area Network (LAN), Wide Area Network (WAN), the Internet, Bluetooth, and Zigbee. In a distributed computing environment, program modules may be located in both local and remote memory storage devices.

Embodiments of the invention may be stored or distributed on tangible computer-readable media, including magnetically or optically readable computer discs, cloud servers, hard-wired or preprogrammed chips (e.g., EEPROM semiconductor chips), nanotechnology memory, biological memory, or other data storage media. Alternatively or additionally, computer implemented instructions, data structures, screen displays, and other data under aspects of embodiments of the invention may be distributed over the Internet and via cloud computing networks or on any analog or digital network (packet switched, circuit switched, or other scheme).

The computer readable medium stores computer data, which data may include computer program code that is executable by a computer, in machine readable form. By way of example, a computer readable medium may comprise computer readable storage media, for tangible or fixed storage of data, or communication media for transient interpretation of code-containing signals. Computer readable storage media, as used herein, refers to physical or tangible storage (as opposed to signals) and includes without limitation volatile and non-volatile, removable and non-removable media implemented in any method or technology for the tangible storage of information such as computer-readable instructions, data structures, program modules or other data. Computer readable storage media includes, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other physical or material medium which can be used to tangibly store the desired information or data or instructions and which can be accessed by a computer or processor.

Applicant has discovered that it would be advantageous to employ an apparatus that allows for effective independent or solo practice of basketball skills as well as independent practice of skills pertaining to other sports (e.g., baseball, football, tennis, volley ball, golf, etc.).

FIG. 1 shows a schematic illustration of a basketball training apparatus 100 being used by a player 105, according to one embodiment. The basketball training apparatus 100 may comprise a tether 110 having a first end affixed to a connector module 115 (shown in FIGS. 2-4) and a second end affixed to a sleeve 120 as a ball securing mechanism. The sleeve 120 is configured to secure a ball 122 therein (e.g., basketball, football, soccer ball, or the like). For example, the sleeve 120 may include multiple longitudinal strips that can be fastened together to form a pocket or pouch to hold the ball 120. The longitudinal strips may be fastened to the other by way of a series of loops and fasteners (e.g., VELCRO). The loop and fastener configuration may be used to secure the longitudinal strips to the other and thus secure the ball 122. Other embodiments might include snaps, zip-ties, buckles, or the like to secure the longitudinal strips to the other and form the pouch to hold the ball 122. Alternatively and/or additionally, the sleeve 120 may comprise a stretchable or elastic pouch that may be expanded to fit large balls. The adjustable nature of the sleeve 120 makes it adaptable to multiple shapes and sizes of balls. For example, embodiments described herein are also applicable to the game of baseball, football, soccer, tennis, volley ball, or golf (to name a few). The sleeve 120 may be used to secure a baseball, football, soccer ball, tennis ball, volley ball, or golf ball to the tether 110.

The tether 110 may comprise any elastic material known in the art. The tether 110 comprises material having elastic properties such that it stretches in response to a pulling force and then bounces back to its original length after stretched to a maximum length. For example, the tether may be a bungee cord. Alternatively, the tether 110 may comprise a non-elastic material coupled to a spool (not illustrated). In response to the pulling force on the tether 110, the spool may be configured to rotate to release additional tether 110 until the maximum length of spooled tether 110 is released. Upon reaching the maximum length of the tether 110, the pull force of the tether 110 on the empty spool actuates the spool to rotate in an opposite direction, thereby causing the tether 110 to retract.

Figure 2:
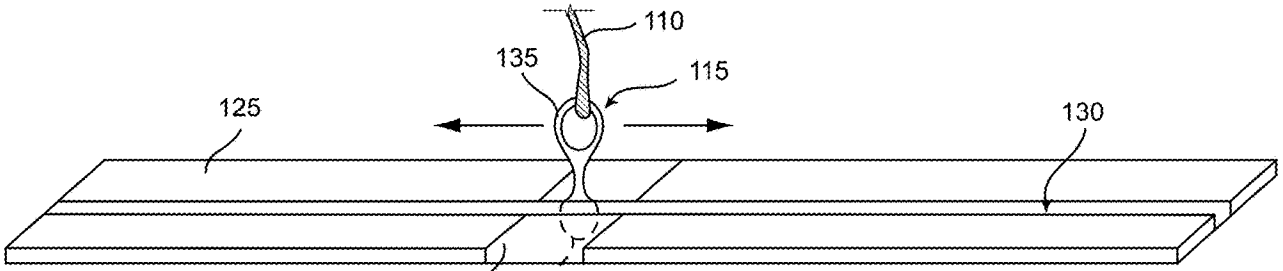
FIG. 2 is a schematic illustration of a track belt portion of the basketball training apparatus having a trackball embedded therein, according to one illustrated embodiment.
Figure 3A:
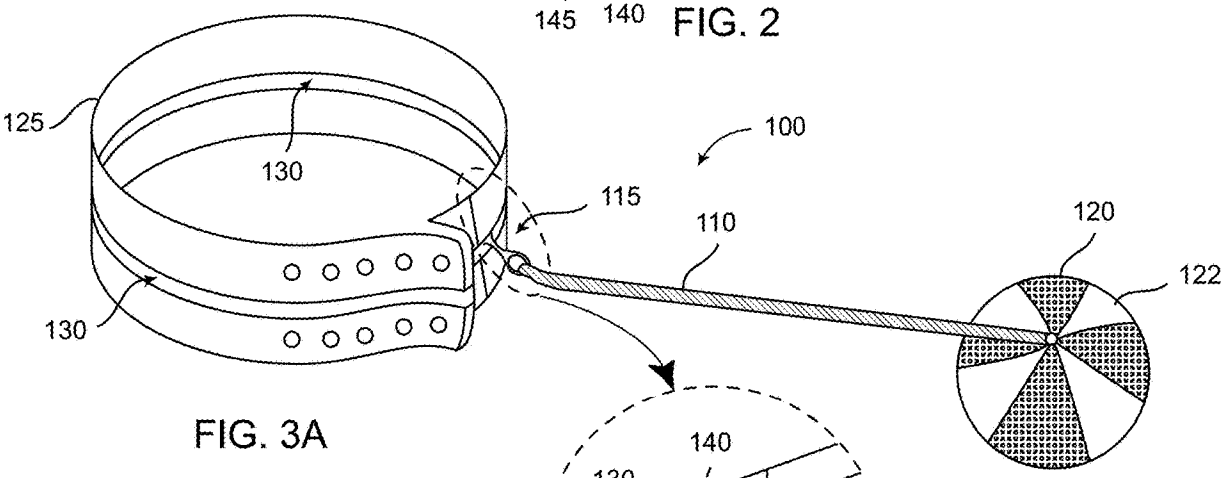
FIG. 3A is a schematic illustration of a connector module coupled to a belt and a tether, the tether having an opposite end coupled to a sleeve that holds a ball, according to one illustrated embodiment.

FIG. 2 shows a schematic illustration of a track and belt portion of the basketball training apparatus 100 having a trackball 140 embedded therein, according to one embodiment. FIG. 3A shows a schematic illustration of connector module 115 coupled to a belt 125 and the tether 110, the tether 110 having an opposite end coupled to the sleeve 120 that holds the ball 122, while FIG. 3B shows a blown up perspective view of the connector module 115, according to one embodiment.

Figure 3B:
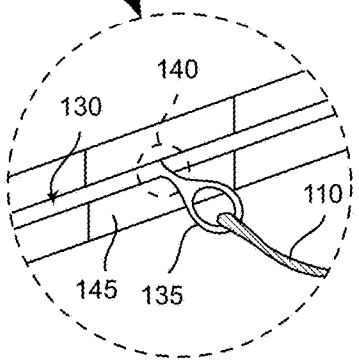
FIG. 3B is a blown up perspective view of the connector module illustrating the trackball and loop portions of the connector module embedded within a track of the belt, according to one illustrated embodiment.

Reference will now be made to FIGS. 2, 3A, and 3B. The connector module 115 may be coupled to the belt 125 that is worn by the player 105. The belt 125 may be worn around the player's waist, for example. The belt 125 may be of any material known in the art. The belt 125 may, for example, be adjustable to the waist size and shape of the player 105 by way of loop and fastener configuration (e.g., VELCRO), snaps, buckles, or the like. The connector module 115 is configured to fasten the tether 110 to the belt 125 while allowing the tether 110 to rotate around the player's waist without entangling. In particular, the connector module 115 may traverse along a length of the belt 125. Because the connector module 115 may traverse a length of the belt 125, it allows the tether 110 and ball 122 configuration to freely rotate around the player's 105 back without tangling the tether 110 or tangling around the player's 105 body. In one embodiment, the first end of the tether 110 may be rotatively fastened to the connector module 115 such that the first end of the tether 110 is operable to spin 360 degrees without tangling the tether 110.

According to one embodiment, the belt 125 comprises a track 130 that may take the form of a groove along the length of the belt 125. As illustrated in FIGS. 2, 3A, and 3B, the connector module 115 may take the form of a fastener having a first end shaped as a loop 135 and a second end shaped as a trackball 140. The trackball 140 portion of the connector module 115 is configured to fit into the track 130 and can be inserted in at least one opening. The opening is at least the same size as the trackball to allow for insertion into the track 130. A belt cap 145 is affixed over the opening to prevent the trackball from being displaced from the track during use. The belt cap 145 may take any form known in the art. For example, the belt cap 145 may be fastened into place via any number of fastening elements known in the art to allow for easy fastening and removal from the belt 125 by the player 105. In other words, the user 105 may couple the trackball 140 portion of the connector module 115 to the track by removing the belt cap 145 and inserting the trackball 140 via the opening. Once inserted, the player 105 may fasten the belt cap 145 onto the track opening to prevent the trackball 140 from escaping from the track 130 during use. In one example, as illustrated in FIG. 1, the player 105 may implement a bounce pass. In a bounce pass scenario, the player's 105 throwing force extends or stretches the tether 110 and the ball bounces on the floor. If the tether 110 has more stretching capability after the bounce, the ball 122 may continue to travel further away from the player 105 (after the bounce) before returning to the player 105.

The training apparatus 100 is advantageous in that the player 105 may perform a behind-the-back pass as well. In such scenario, the player 105 implements a behind-the-back pulling force on the tether 110 by way of turning the ball 122 behind the back and making a passing motion. In response to the behind-the-back motion and force on the tether 110, the trackball 140 traverses the length of the belt 125 along the track 130 in a swift motion. The traversal of the belt 125 track 130 is swift and with reduced friction because of the free rotation capability of the trackball 140. The swift or minimal friction traversal of the trackball 140 along the belt 125 allows for a simulation of an actual behind the back pass to another player who may be located behind, parallel to, or even ahead of the passing player 105. Because the ball 122, tether 110, and connector module 115 all traverse around the player's 105 body in response to the behind-the-back force of the player 105, there is no entanglement of the tether 110 around the player 105. This results in the player 105 having the ability to repeat the behind-the-back passing technique multiple times in series rather than having to practice the behind-the back pass once before entanglement occurs and manual disentanglement is required.

As discussed above, the connector module 115 comprises the loop 135 and trackball 140. The loop 135 may be any rigid or non-rigid material known in the art configured to securely affix the tether 110 thereto. For example, the loop 135 may be a rigid metal loop. In another embodiment, the loop 135 may, for example, be a carabiner with a spring-loaded gate (e.g., snap-link) that quickly accepts the tether 110 and also quickly allows for the player 105 to detach the tether 110. The trackball 140 may be configured similarly to a computer mouse with an exposed protruding ball that is rotatable about two axes (i.e., longitudinal and horizontal axes). Once embedded within the track 130 of the belt 125, the protruding ball of the trackball 140 may be limited to rotation along a single latitudinal axis along the belt 125. This latitudinal movement and rotation of the protruding ball in the trackball 140 provides the limited friction and quick traversal of the tether 110 around the player's 105 waist. The trackball's 140 limited friction rotational movement around the player's 105 waist in response to the behind-the-back force, for example, may be characterized by a fast zipping of the tether 110 around the waist.

In one embodiment, the connector module 115 may include a sensor (not shown) operable to detect an amount of force pulling the tether 110 away from the connector module 115 and an angle of the force. Additionally, the connector module 115 may further include a transmitter (not shown) operable to transmit the amount of the force and the angle of the force to a processor. According to one embodiment, the sensor is embedded within a socket that holds the protruding ball of the trackball 140, while in another embodiment the sensor is embedded within the loop 135 of the connector module 115. The processor extrapolates an estimated target location of the ball 122 based on the amount of the force pulling the tether 110 and the angle of the force. In one implementation, the player 105 may have a mobile device that is embedded with the processor such that a determination of the target ball 122 location is visualized on the mobile device. An application may be contemplated for use with the mobile device that provides a user-friendly interface for the player 105 to review projected ball placement and trajectory. Additionally, an accelerometer (not shown) may be employed by the training apparatus 100 to more accurately determine a trajectory of the ball 122. For example, the accelerometer may be embedded proximate the connector module 115 to sense accelerated movement of the connector module 115 along the belt 125. The processor may then consider the accelerated movement of the connector module 115, in addition to the sensed pulling force on the tether 110 and the angle of the force, when extrapolating the estimated target location of the ball 122.

Figure 4:
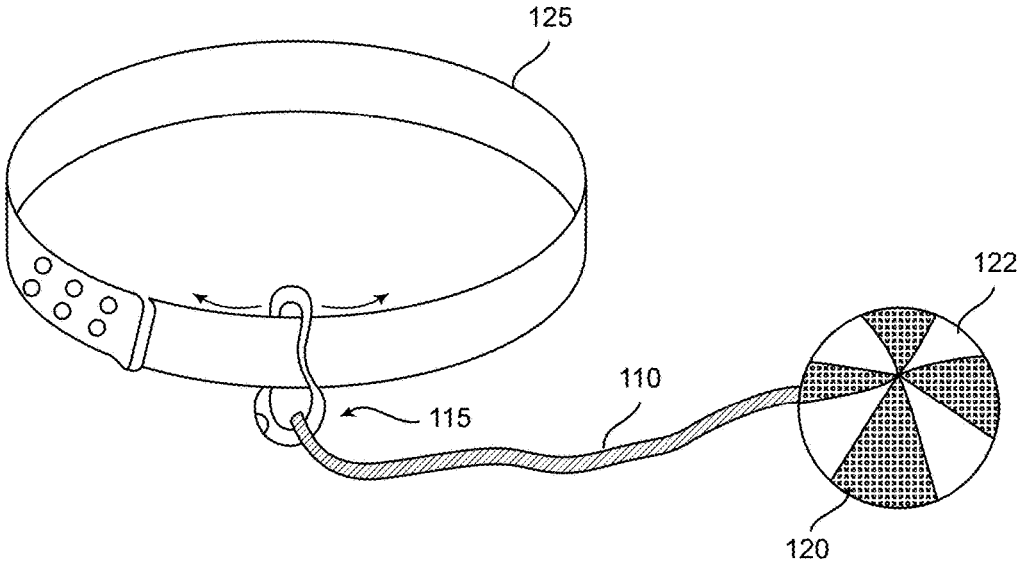
FIG. 4 is a schematic illustration of the connector module taking a form of a carabiner clip coupled to the belt and to the tether, according to one illustrated embodiment.

FIG. 4 shows a schematic illustration of the connector module 115 taking a form of a carabiner clip coupled to the belt 125 and to the tether 110, according to one embodiment. In the alternative embodiment illustrated in FIG. 4, the connector module 115 may, for example, be a carabiner clip. The carabiner clip may be any type known in the art. For example, the carabiner may have a spring-loaded gate that is a straight gate, wire gate, or locking gate type. In the FIG. 4 embodiment, the tether 110, ball 122, and connector module 115 may all rotate around the belt 125 without entangling with the player's body. In contrast to the trackball 140 configuration, the carabiner glides along the outer periphery of the belt 125. It would be advantageous to select belt material that reduced the friction with the carabiner such that a smooth movement along the belt 125 occurs in response to the player's 105 pulling force on the tether 110.

Figure 5:
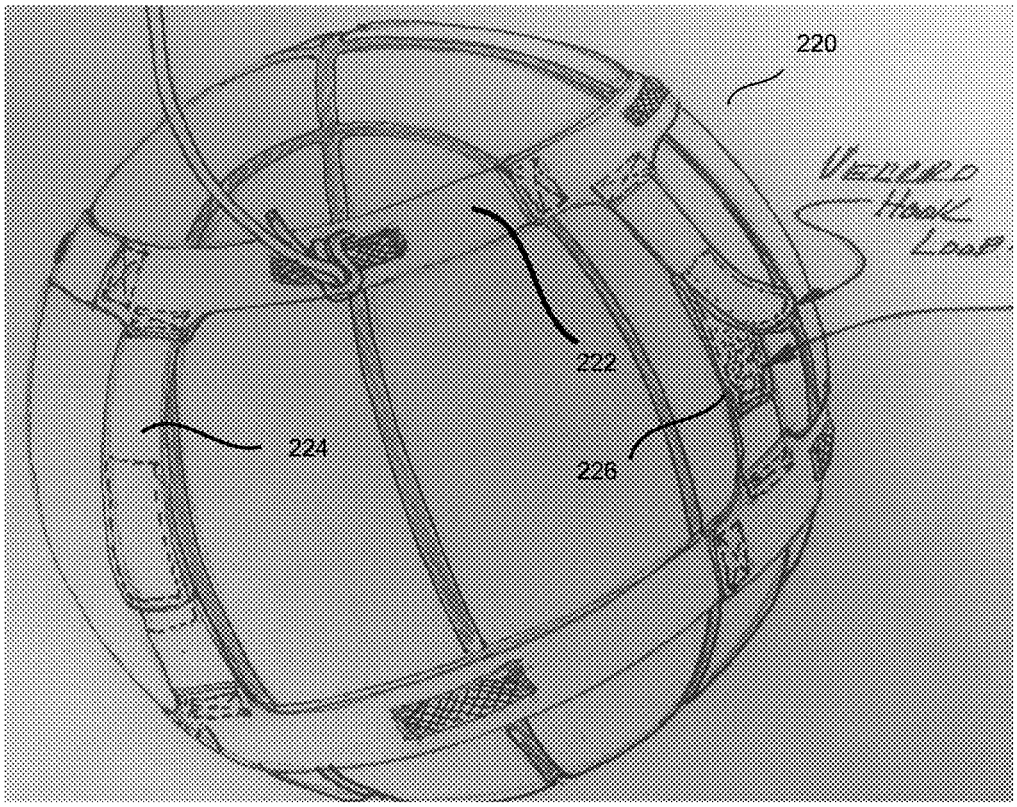
FIG. 5 is a schematic illustration of an alternative ball securing mechanism.

FIG. 5 illustrates ball securing mechanism 220 that can be used in place of sleeve 120. Ball securing mechanism 220 includes two substantially circular straps 222 defining a diameter that is somewhat less than the diameter of the ball to be secured therein. Each circular strap 222 has plural linear straps 224 extending therefrom. The linear straps 224 connect to corresponding linear straps on the other circular strap 222 by a connection mechanism, such as Velcro, shown at 226. Any appropriate connection mechanism can be used such as snaps, latches. laces, buckles, or the like.

Having described some embodiments of the invention, additional embodiments will become apparent to those skilled in the art to which it pertains. Specifically, although reference was made to a basketball and basketball training drills or passing throughout the specification and drawings, it will be appreciated that the training apparatus is also relevant for football, soccer, baseball, tennis, volley ball, and golf to name a few. The embodiment of a basketball player running passing drills was described merely to readily convey various aspects of the training apparatus but was not intended to limit the training apparatus to the basketball sport. For example, the training apparatus may be advantageous to any sport requiring accurate tossing skills of a ball.

Additionally, although the ball 122 was illustrated as a basketball, any other ball is contemplated, such as for example a football, soccer ball, baseball, volley ball, golf ball, and tennis ball. For example, it is within the scope of embodiments of the invention to have a football secured within the sleeve 120 or other another ball securing mechanism. A quarterback wearing the training apparatus 100 may run practice passing drills by tossing the football secured within the sleeve 120 to an intended receiver. The football returns to the quarterback in response to the tether 110 reaching maximum expansion. Analogously, it is contemplated by those of ordinary skill in the art that a soccer player, baseball player, volley ball player, golfer, and tennis player may similarly leverage the training apparatus to run their own training drills pertaining to each sport. Further, the ball securing mechanism can be any appropriate mechanism for securing the specific ball and need not be limited to the particular examples expressly disclosed herein. It will be appreciated by those of ordinary skill in the art that the connector module 115 may traverse the belt in any direction (e.g., clockwise, counter-clockwise).

While the particular methods, devices and systems described herein and described in detail are fully capable of attaining the above-described objects and advantages of the invention, it is to be understood that these are the presently preferred embodiments of the invention and are thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular means "one or more" and not "one and only one", unless otherwise so recited in the claim.

It will be appreciated that modifications and variations of the invention are covered by the above teachings and within the purview of the appended claims without departing from the spirit and intended scope of the invention.

The invention claimed is:

1. An apparatus, comprising:

a tether having a first end affixed to a connector module and a second end affixed to a ball securing mechanism, wherein the ball securing mechanism is configured to secure a ball therein; and a belt configured to have the connector module engaged therewith, the belt worn around a waist of a user, the connector module operable to traverse a length of the belt, wherein the connector module comprises a first end shaped as a loop and a second end shaped as a trackball and wherein the first end of the tether is fastened to the loop;

wherein the belt comprises a track configured to receive the trackball of the connector module therein, the connector module operable to traverse the track along the belt and wherein the belt further comprises a belt cap configured to prevent the trackball from being displaced from the track;

wherein the connector module, tether, and the ball can freely rotate around the user's waist in response to the user applying a behind-the-back force to the ball; and the connector module further comprising:

a sensor operable to detect an amount of force pulling the tether away from the connector module and an angle of the force; and a transmitter module operable to transmit the amount of the force and the angle of the force to a processor.

2. The apparatus of claim 1, wherein the first end of the tether is rotatively fastened to the loop such that the first end of the tether is operable to spin without tangling the tether.

3. The apparatus of claim 1, wherein the processor is configured to extrapolate the estimated target of the ball based on the amount of the force pulling the tether and the angle of the force.

4. The apparatus of claim 3, wherein the processor is embedded within a mobile device.

5. The apparatus of claim 1, wherein the ball securing mechanism is a pouch adjustable to fit one or more sizes and shapes of the ball.

6. The apparatus of claim 5, wherein the tether is of elastic material such as, for example, a bungee cord.

7. The apparatus of claim 1, wherein the ball securing mechanism comprises two substantially circular straps, each circular strap having multiple linear straps extending therefrom, and a coupling mechanism associates with each liner strap for coupling each liner strap to a corresponding linear strap extending form the other circular strap.

* * * * *